US007905190B2

(12) United States Patent
Shimizu

(10) Patent No.: US 7,905,190 B2
(45) Date of Patent: Mar. 15, 2011

(54) SEWING MACHINE

(75) Inventor: Masaki Shimizu, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1085 days.

(21) Appl. No.: 11/657,675

(22) Filed: Jan. 25, 2007

(65) Prior Publication Data

US 2007/0186831 A1 Aug. 16, 2007

(30) Foreign Application Priority Data

Feb. 16, 2006 (JP) ..... 2006-039095

(51) Int. Cl.
*D05B 65/00* (2006.01)
*D05B 47/00* (2006.01)

(52) U.S. Cl. ..... 112/286; 112/291; 112/254

(58) Field of Classification Search ..... 112/275, 112/286, 291, 294–298
See application file for complete search history.

(56) References Cited

U.S. PATENT DOCUMENTS

| | | | | |
|---|---|---|---|---|
| 4,403,562 | A * | 9/1983 | Tancs | 112/275 |
| 4,630,559 | A * | 12/1986 | Kinoshita | 112/291 |
| 5,025,738 | A * | 6/1991 | Sato et al. | 112/286 |
| 5,025,739 | A * | 6/1991 | Inoue | 112/286 |
| 6,860,213 | B2 | 3/2005 | Shimizu | |
| 6,907,834 | B2 * | 6/2005 | Noguchi et al. | 112/293 |
| 7,093,549 | B2 * | 8/2006 | Fujihara | 112/286 |

FOREIGN PATENT DOCUMENTS

| | | |
|---|---|---|
| JP | A 59-211487 | 11/1984 |
| JP | A 4-348794 | 12/1992 |
| JP | A 5-228289 | 9/1993 |
| JP | A 5-228290 | 9/1993 |
| JP | A 7-39669 | 2/1995 |
| JP | A 8-57181 | 3/1996 |
| JP | A 11-137879 | 5/1999 |
| JP | B2 2975760 | 11/1999 |
| JP | 2004-290293 | 10/2004 |

* cited by examiner

*Primary Examiner* — Ismael Izaguirre
(74) *Attorney, Agent, or Firm* — Oliff & Berridge, PLC

(57) ABSTRACT

In a sewing machine, a control device is configured to execute a needle thread cutting operation including driving a movable cutting blade to a predetermined pivot location, driving a wiper driving mechanism for protruding a wiper by a predetermined stroke, driving the thread take-up driving mechanism to lower the thread take-up by a predetermined distance, driving a wiper driving mechanism to draw back the wiper by a predetermined amount corresponding to the lowering of the thread take-up, driving the movable cutting blade to a standby position, driving the thread tension adjusting mechanism to release a thread tension adjusting mechanism, and driving the thread take-up driving mechanism to move the thread take-up to an original uppermost position.

2 Claims, 11 Drawing Sheets

SEWING MACHINE

CROSS-REFERENCE TO RELATED APPLICATIONS

This application is based upon and claims the benefit of priority from the prior Japanese Patent Application No. 2006-39095 filed on Feb. 16, 2006, the entire contents of which are incorporated herein by reference.

BACKGROUND

1. Technical Field

The present disclosure relates to a sewing machine provided with a thread wiper which is actuated for securement of an amount of thread immediately before the cutting of a needle thread by a thread cutting mechanism so that a predetermined amount of needle thread located downstream relative to a needle eye of a sewing needle is secured.

2. Description of the Related Art

When workpiece cloth is sewn by various types of sewing machines, it has been conventionally ideal that a needle thread is prevented from dropping out of a needle eye and moreover, an end of the needle thread is prevented from remaining on an upper side of the workpiece cloth. Various types of sewing machines have been proposed which prevent the needle thread from dropping out of the needle eye or the end of the needle thread from remaining at the upper side of the workpiece cloth.

JP-A-2004-290293 discloses a sewing machine including a picker for retaining a needle thread. The picker is provided in front of a rotary hook provided in a front end of interior of a cylinder bed. The picker is pivotable over a needle thread retaining position, a standby position and a retreated position. The picker is designed to be switchable so as to be moved to the three positions via a linking member coupled to a picker driving motor. In the disclosed sewing machine, the picker is switched to the needle thread retaining position when the needle thread is cut. As a result, the needle thread engages the picker so that a predetermined amount of remaining thread can be secured.

JP-A-H08-57181 discloses a thread cutter for sewing machines including a movable cutting blade which is moved from a standby position to a pivot position (a first half of reciprocal movement) in cutting a thread so that a needle thread and a bobbin thread at the workpiece cloth side engage the movable cutting blade. The timing of returning movement of the cutting blade (a second half of the reciprocal movement) is changed in synchronization with rise of a thread take-up, that is, retarded so that an amount of remaining needle thread after thread cutting is adjustable, whereupon no picker is necessitated.

In the sewing machine disclosed by JP-A-2004-290293, however, the front end of the cylinder bed is extended to the distal end side since the picker is disposed in front of the rotary hook. Accordingly, the distance from the sewing needle to the cylinder bed is increased, whereupon a sewable area is narrowed in the cross direction in the case where an embroidery is sewn on a cap. Furthermore, since the picker driving motor is necessitated as well as the picker and the linking member, the size of the cylinder bed is increased. The production cost of the sewing machine is increased since the number of components is increased.

Additionally, although no picker is necessitated in the thread cutter disclosed by JP-A-H08-57181, an amount of remaining needle thread depends upon the synchronization of rise of the thread take-up with the timing of the second half of reciprocation of the cutter blade. As a result, an amount of remaining needle thread tends to be adversely affected by the material of workpiece cloth or needle thread.

SUMMARY

Therefore, an object of the present disclosure is to provide a sewing machine in which no picker is necessitated such that the size of the cylinder bed can be reduced and a sewable range can be increased and a necessary amount of needle thread remaining after thread cutting can be secured reliably and accurately.

The present disclosure provides a sewing machine comprising a thread take-up; a thread take-up driving mechanism which drives the thread take-up; a sewing machine motor which drives the thread take-up driving mechanism; a thread cutting mechanism including a fixed cutting blade and a movable cutting blade both of which cut the needle thread and a movable cutting blade driving mechanism which drives the movable cutting blade; a thread wiper which wipes the cut needle thread away over workpiece cloth to be sewn; a wiper driving mechanism which drives the thread wiper; a thread tension adjuster which adjusts a tension of the needle thread; a thread tension adjuster driving mechanism which drives the thread tension adjuster; and a control device coupled to the sewing machine motor, the thread cutting mechanism, the wiper driving mechanism and the thread tension adjuster driving mechanism, wherein the control device is configured to execute a needle thread cutting operation including driving the movable cutting blade to a predetermined pivot location (S12); driving the wiper driving mechanism for protruding the wiper by a predetermined stroke (S17); driving the thread take-up driving mechanism to lower the thread take-up by a predetermined distance (S18); driving the wiper driving mechanism to draw back the wiper by a predetermined amount corresponding to the lowering of the thread take-up (S19); driving the movable cutting blade to a standby position (S21); driving the thread tension adjusting mechanism to release the thread tension adjusting mechanism (S23); and driving the thread take-up driving mechanism to move the thread take-up to an original uppermost position (S24).

According to the above-described arrangement, the control device firstly controls the movable cutting blade driving mechanism when receiving a needle thread cutting command upon end of a sewing process. In the state previous to cutting of the needle thread where the needle thread is caught by the movable cutting blade, the control device controls the wiper driving mechanism so that the distal end of the thread wiper engages the needle thread and then so that the wiper driving mechanism is operated for securement of the predetermined amount of needle thread. In this case, the predetermined amount of needle thread located downstream relative to the needle eye of the sewing needle is secured by the thread wiper. Thus, the predetermined extra amount of needle thread is secured. In this state, the control device controls the movable cutting blade driving mechanism so that the needle thread is cut by the movable cutting blade. Consequently, an amount of remaining needle thread after cutting can be increased according to an amount of operation of the wiper for securement of thread amount.

In the above-described case, an extra amount of remaining needle thread after cutting thereof can be secured by the thread amount securing operation of the thread wiper without picker nor picker driving motor provided in the cylinder bed. Consequently, the production cost can be reduced as the result of a reduction in the number of components, and the size of the cylinder bed can be reduced. Furthermore, a necessary amount of remaining needle thread after thread cutting can be secured reliably and accurately. Additionally, since no picker is necessitated, the distance between a rotary hook and the front end of the cylinder bed can be shortened. Consequently, a sewable area can be enlarged.

BRIEF DESCRIPTION OF THE DRAWINGS

Other objects, features and advantages of the present disclosure will become clear upon reviewing the following description of the embodiment with reference to the accompanying drawings, in which.

DETAILED DESCRIPTION OF THE DISCLOSURE

One embodiment of the present disclosure will be described with reference to the accompanying drawings. The disclosure is applied to a multi-needle embroidery machine in the embodiment.

Figure 1:
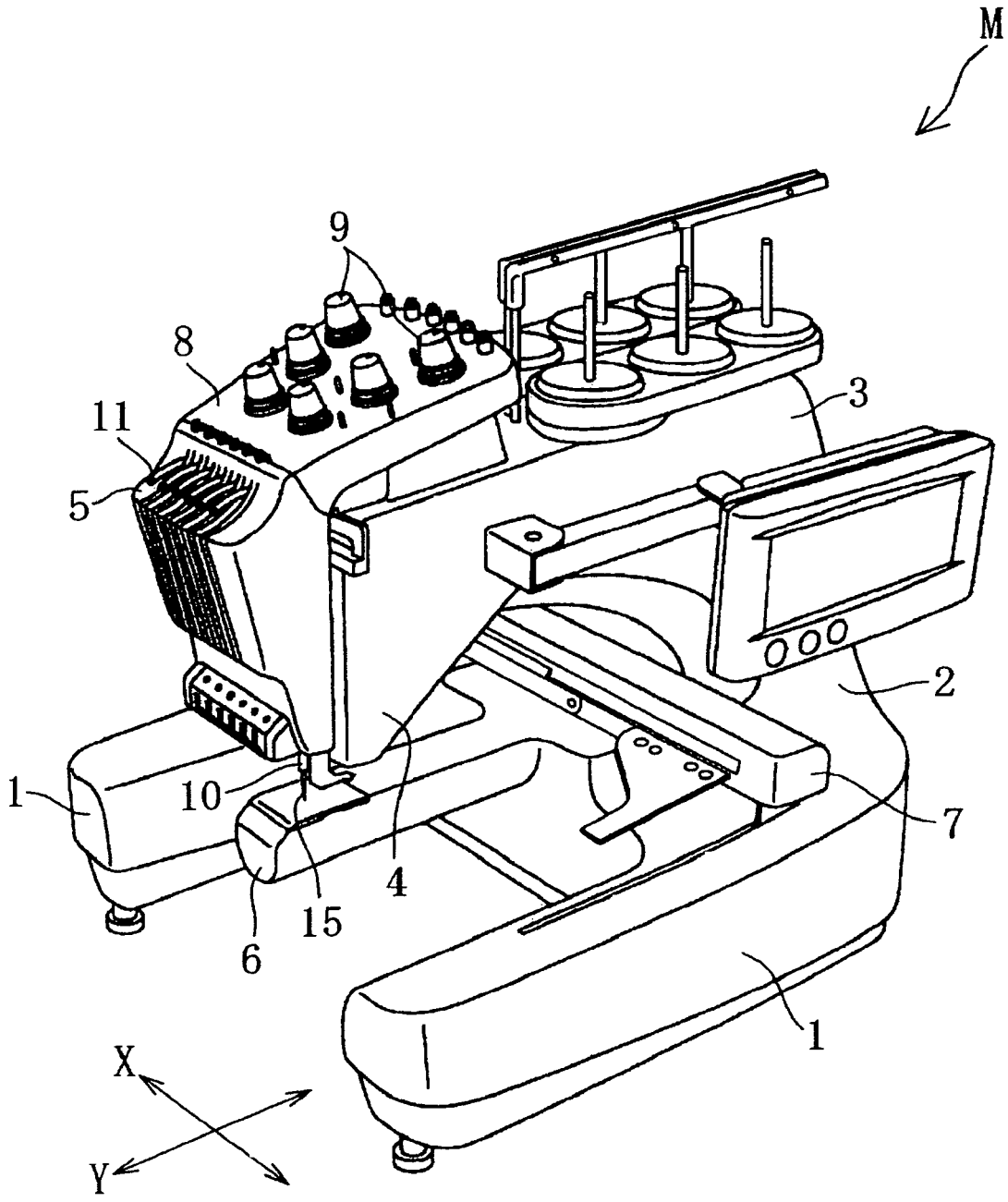
FIG. 1 is a perspective view of a whole multi-needle embroidery machine of one embodiment in accordance with the present disclosure.

Referring to FIG. 1, the multi-needle embroidery machine M of the embodiment is shown. The multi-needle embroidery machine M includes a pair of left and right support legs 1, a pillar 2 standing from rear ends of the support legs 1, an arm 3 extending frontward from an upper end of the pillar 2, a needle bar case 5 which is mounted on a head 4 which is a distal end of the arm 3 so as to be movable horizontally, a cylinder bed 6 extending frontward from a lower end of the pillar 2, a frame moving mechanism (not shown) which moves a carriage 7 and accordingly an embroidery frame (not shown) mounted on the carriage 7 in the X-direction and the Y-direction perpendicular to the X-direction and the like. The description of the frame moving mechanism will be eliminated.

In the head 4 are provided a needle bar driving mechanism 30 selectively transmitting a vertical driving force to one of a plurality of needle bars 10 provided in the needle bar case 5, a needle bar releasing mechanism 31 which intermits transmission of the driving force of the needle bar driving mechanism 30 and a wiper driving mechanism 32 driving a thread wiper 62 for a wiping operation.

On a front end of the cylinder bed 6 are mounted a thread cutting mechanism 33 (see FIG. 7) for cutting a needle thread 28 and a bobbin thread, a rotary hook 6A (see FIG. 3) and the like. When a needle bar changeover motor 83 (see FIG. 8) is driven at the time of embroidery thread change, the needle bar case 5 is horizontally moved so that the needle bar driving mechanism 30 corresponds to one of the needle bars 10.

The needle bar case 5 is provided with six needle bars 10 extending vertically, six thread take-ups 11 which are swingably mounted on the needle bar case 5 at locations corresponding to the needle bars 10 respectively, a first needle bar guiding member 12 and a second needle bar guiding member 13 both fixed to the needle bar case 5 to guide the needle bars 10, a horizontally extending first thread retaining member 14 supported on both ends of a fixed plate 17 secured to the needle bar case 5, six second thread retaining members 16 which are provided so as to correspond to sewing needles 15 mounted on lower ends of the needle bars 10 respectively, a presser foot 21 and the like.

Figure 3:
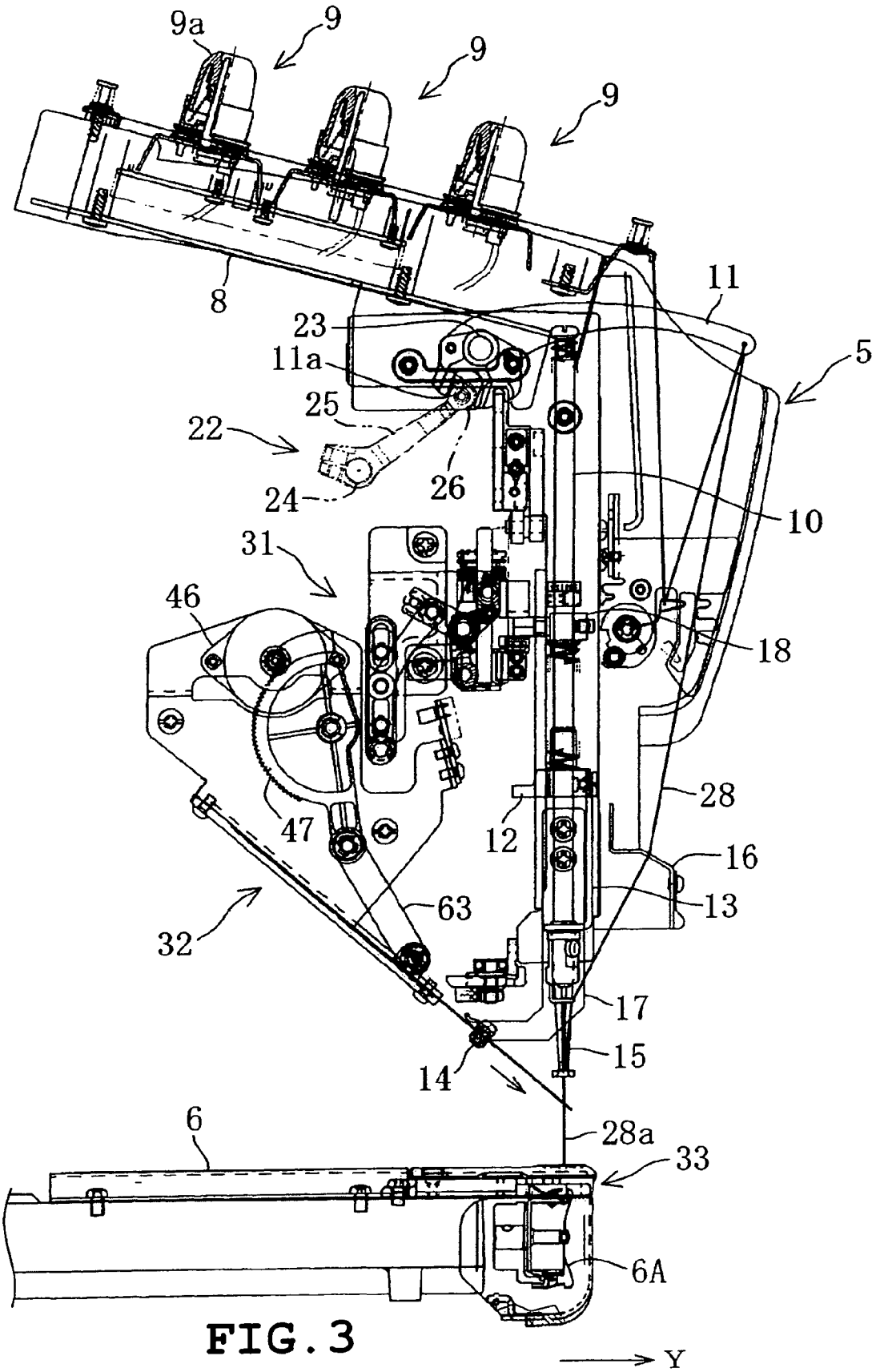
FIG. 3 is a partial longitudinally sectional left side view of the needle bar case.

A tension guide 8 is formed integrally on an upper end of the needle bar case 5 and provided with six thread tension adjusting mechanisms 9 as shown in FIG. 3. Each thread tension adjusting mechanism 9 includes a thread tension adjusting knob 9*a* which adjusts a resilient biasing force pressing a movable disc against a fixed disc, neither disc being shown. Each thread tension adjusting mechanism 9 is constructed so that the needle thread 28 is held between the movable and fixed discs so as to be tensioned. A thread tension disc opening solenoid 85 (shown only in FIG. 8) is provided in each thread tension adjusting mechanism 9 so as to be located in the needle bar case 5. When each thread tension disc opening solenoid 85 is operated, the movable disc is slightly moved away from the fixed disc such that the thread tension adjusting mechanism 9 is released, whereupon the needle thread 28 is not tensioned.

A coupling member 18 is secured to a vertically middle part of each needle bar 10. The coupling member 18 has a coupling pin 18*a* to which is transmitted a drive force from the needle bar driving mechanism 30. A compression coil spring 19 (see FIG. 4) is provided about each needle bar 10 between the coupling member 18 and the first needle bar guiding member 12. The compression coil spring 19 upwardly biases the needle bar 10. Six sewing needles 15 are attached to lower ends of the needle bars 10 respectively. Embroidering needle threads 28 are supplied from thread spools (not shown) provided on an upper part of the arm 3 to the needles 15 respectively. The first thread retaining member 14 is provided for retaining the needle thread 28 drawn up by the thread wiper 62. The first thread retaining member 14 has a hook-shaped thread retaining tape 14*a* and reinforcement plates 14*b* holding the tape 14*a* therebetween.

The needle bar case 5 is moved right and left by a needle bar changeover motor 83 so that one of the sewing needles 15 is switched to a sewing location opposed to a needle hole (not shown) of a distal end of the cylinder bed 6. As a result, the drive force of the sewing machine motor 81 is transmitted through a sewing machine main shaft to the needle bar driving mechanism 30 so that the needle bar 10 selected by the vertical drive of the needle bar driving mechanism 30 is driven up and down, forming stitches on workpiece cloth in cooperation of the needle 15 and the rotary hook 6A.

The following will describe a thread take-up driving mechanism 22 vertically driving the thread take-up 11. The thread take-up 11 is mounted on a support shaft 23 so as to be vertically swingable as shown in FIG. 3. A thread take-up swinging lever 25 is secured to a thread take-up swinging shaft 24 which is caused to pivot by rotation of the sewing machine main shaft. The swinging lever 25 has a distal end on which a rolling member 26 engages a bifurcated part 11*a* of the thread take-up 11. Accordingly, when sewing is carried out, the thread take-up 11 is reciprocally driven vertically via the swinging shaft 24 and the swinging lever 25.

Figure 4:
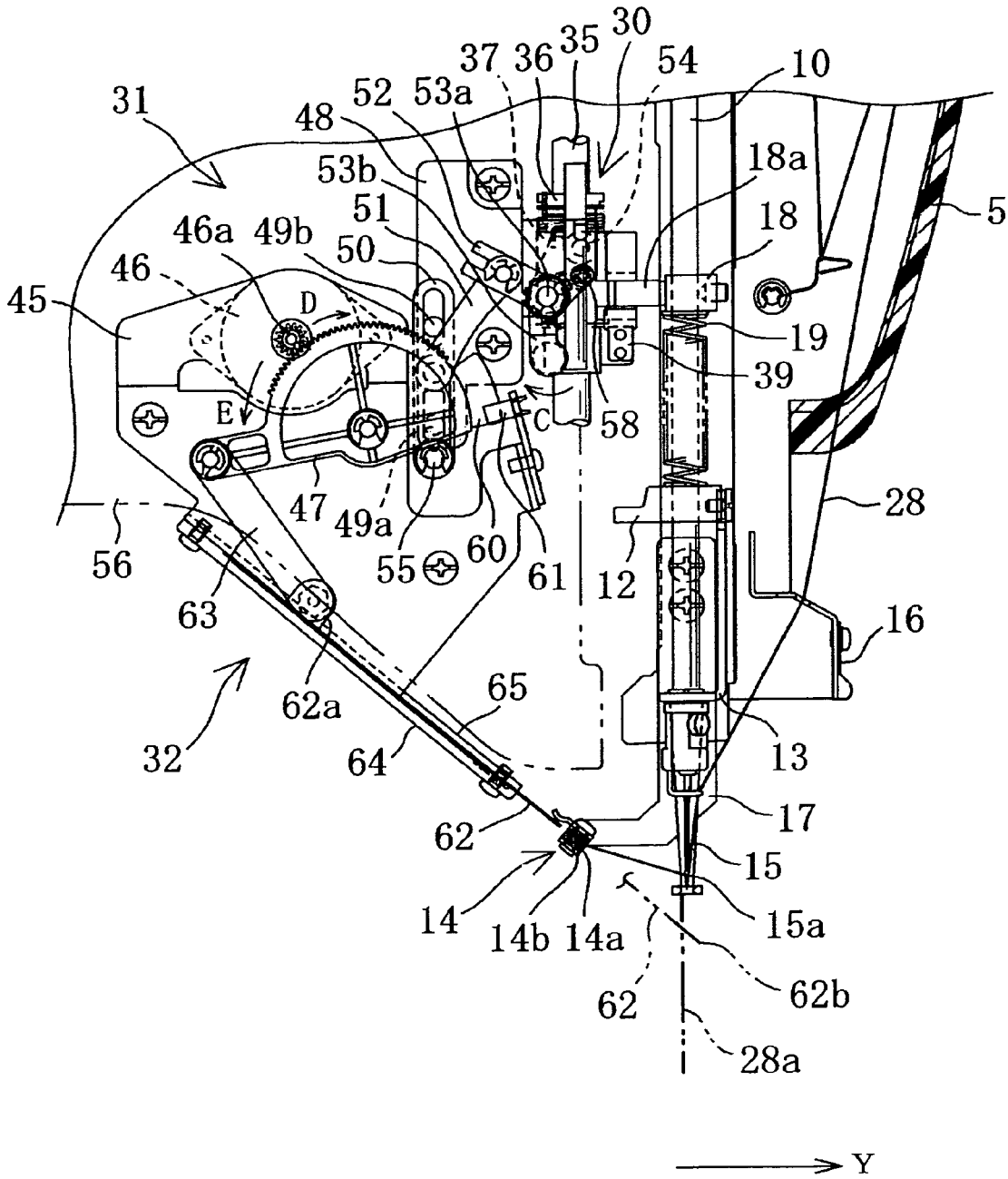
FIG. 4 is a partial enlarged side view of the needle bar case as shown in FIG. 3.
Figure 5:
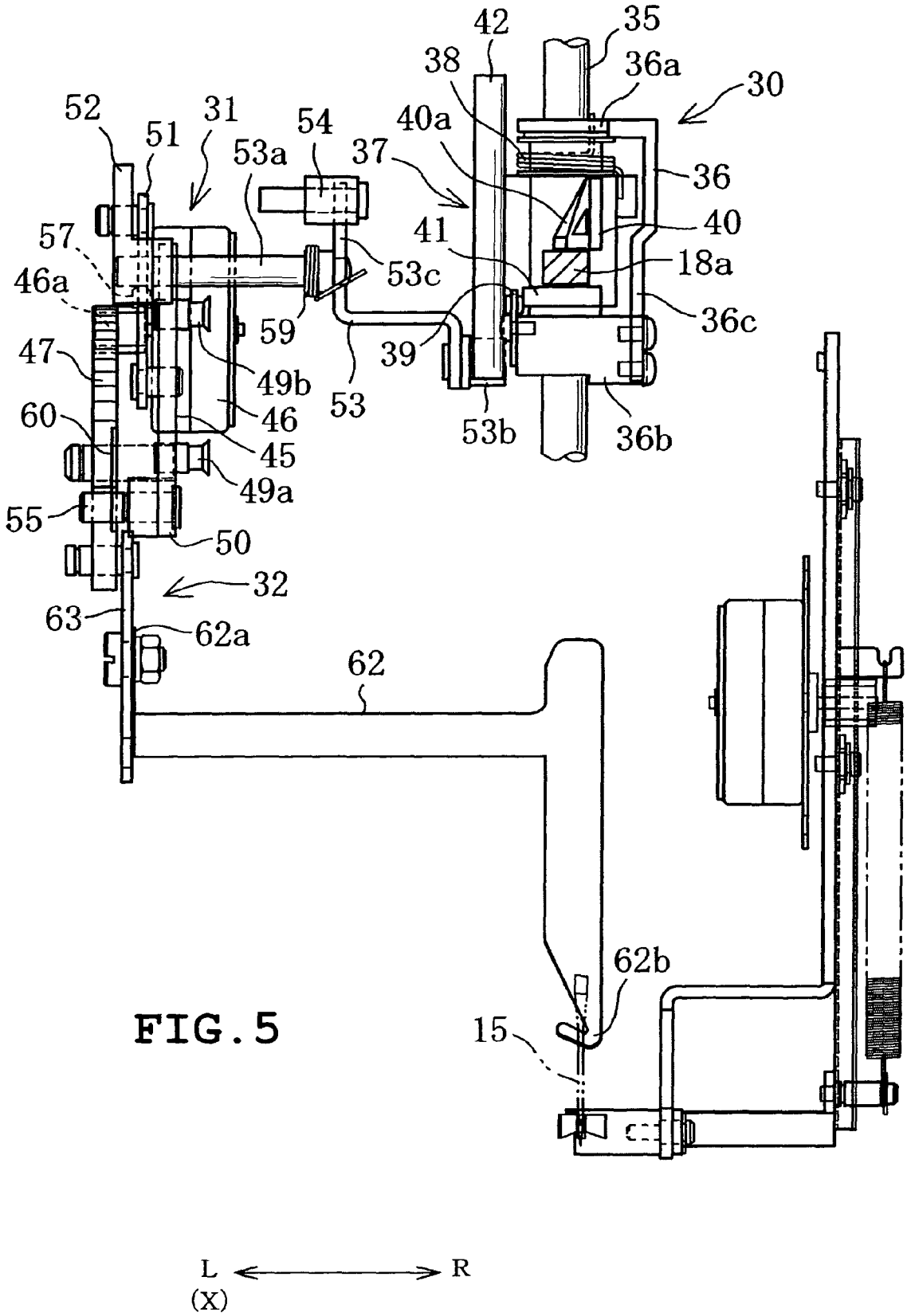
FIG. 5 is a partial front view of the interior of the needle bar case.
Figure 6:
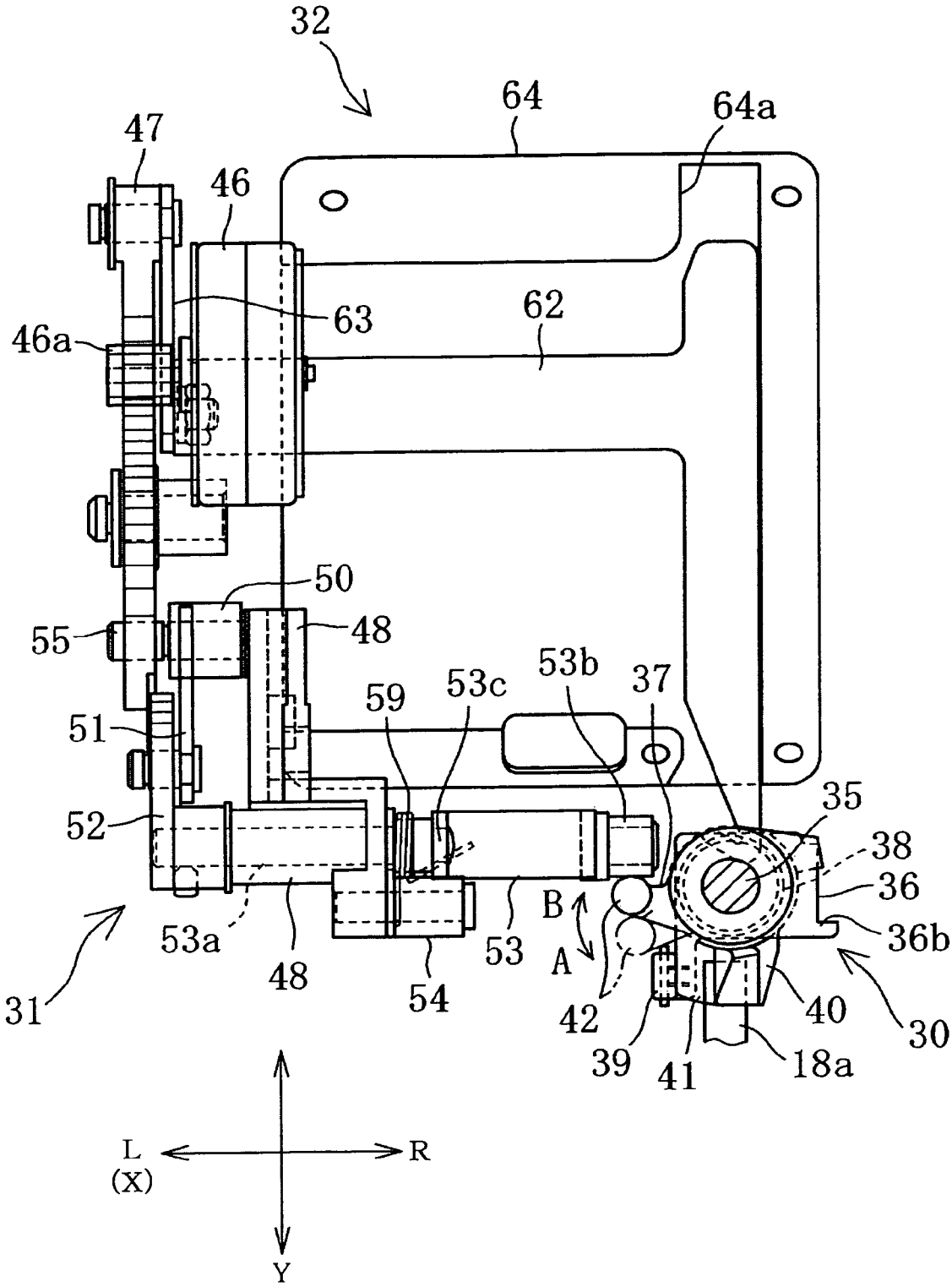
FIG. 6 is a partial plan view of the interior of the needle bar case.

Next, the needle bar driving mechanism 30 will be described. Referring to FIGS. 4 to 6, the needle bar driving mechanism 30 comprises a base needle bar 35 provided in parallel with the needle bar 10, a driving member 36 mounted on the base needle bar 35 so as to be slidable and non-rotatable, a transmitting member 37 mounted together with the driving member 36 so as to be capable of being vertically driven and so as to be rotatable relative to the base needle bar 35 and a first helical spring 38 (see FIG. 5) having one end abutting the driving member 36 and the other end abutting the transmitting member 37 thereby to bias the transmitting member 37 to a transmitting location where the transmitting member 37 is capable of transmitting a drive force.

The driving member 36 has upper and lower driving members 36*a* and 36*b* both fitted with the base needle bar 35 and a connecting member 36*c* connecting the driving members 36*a* and 36*b* to each other. A first coil spring 38 is provided about the upper driving member 36*a*. A stopper 39 is secured to a left side surface of the lower driving member 36*b* in order to limit rotation of the transmitting member 37 to a predetermined angle. The transmitting member 37 is mounted between the upper and lower driving members 36*a* and 36*b*. The transmitting member 37 has first and second engagement members 40 and 41 each of which engages the coupling pin 18*a*, and an abutment pillar 42 to which a rotating force is transmitted so that the needle bar 10 is released by the needle bar releasing mechanism 31. The first engagement member 40 has an inclined part 40*a* (see FIG. 5) which is provided for rotating the transmitting member 37 in the direction of arrow A in FIG. 6 when the inclined part 18*a* in the released state abuts the first engagement member 40.

The needle bar releasing mechanism 31 will be described. The needle bar releasing mechanism 31 includes a drive motor 46 comprising a pulse motor and mounted on a fixing member 45, a sector gear brought into mesh engagement with a driving gear 46*a* secured to an output shaft of the drive motor 46, a guided plate 50 which is guided by guide pins 49*a* and 49*b* both secured to the fixing member 48 so as to be vertically movable, a first linking member 51 having a lower end swingably coupled to a central part of the guided plate 50, a second linking member 52 swingably coupled to an upper end of the first linking member 51, an abutting member 53 swinging together with the second linking member 52 and a stopper 54 fixed to the fixing member 48.

A front half of the sector gear 47 has a lower end which is in abutment with an abutment pin 55 secured to the lower end of the guided plate 50. The fixing members 45 and 48 are fixed to predetermined positions on the left sewing machine frame 56 respectively. The abutting member 53 has a shaft 53*a* pivotally mounted on the fixing member 48 and fixed to the second linking member 52 by a screw 57, a first abutting part 53*b* abutting the abutment pillar 42 of the transmitting member 37 and a second abutting part 53*c* abutting the stopper 54. A second helical spring 59 is fitted with a right end of the shaft 53*a*. The second helical spring 59 has one end fixed to a screw 58 in threading engagement with the fixing member 48. The abutting member 53 is biased in the direction of arrow C in FIG. 4 by the second helical spring 59 except when releasing the needle bar 10. The second abutting part 53*c* is in abutment with the stopper 54.

When the needle bar 10 is to be released by the needle bar releasing mechanism 31, the drive motor 46 is driven so that the sector gear 47 is caused to pivot in the direction of arrow D in FIG. 4 to move the guided plate 50 downward. The lower end of the first linking member 51 is moved downward as the result of movement of the guided plate 50. With the movement of the first linking member 51, the second linking member 52 is rotated about the shaft center of the shaft 53*a* in the direction opposite arrow C together with the abutting member 53. Since the abutting member 53 presses the abutment pillar 42 of the transmitting member 37 in abutment with a first abutting part 53*b*, the transmitting member 37 is rotated in the direction of arrow A in FIG. 6 until the abutment pillar 42 abuts the stopper 39 (see the abutment pillar 42 shown by two-dot chain line in FIG. 6). The first and second engaging members 40 and 41 are disengaged from the coupling pin 18*a* as the result of the rotation of the transmitting member 37. Accordingly, the needle bar 10 is moved to an uppermost position by the biasing force of the compression coil spring 19. In this released state, the raising and lowering drive force of the needle bar driving mechanism 30 is not transmitted to the needle bar 10.

The following will describe the case where the needle bar 10 is switched from the aforesaid released state to a transmissible state where the raising and lowering drive force of the needle bar driving mechanism 30 is transmissible to the needle bar 10. Firstly, the transmitting member 37 is driven upward by the sewing machine motor 81 so that the coupling pin 18*a* is caused to abut against the inclined part 40*a* from above, whereupon the transmitting member 37 is rotated in the direction of arrow A in FIG. 6. Consequently, the transmitting member 37 is moved upward such that the coupling pin 18*a* is located between the first and second engagement members 40 and 41. Accordingly, the biasing force of the helical spring 38 rotates the transmitting member 37 in the direction of arrow B in FIG. 6, so that the coupling pin 18*a* engages the first and second engagement members 40 and 41 thereby to be coupled to the needle bar 10 so that the needle bar 10 is vertically movable.

A wiper driving mechanism 32 moves the thread wiper 62 forward and then draw the thread wiper 62 back when a thread of jump stitch is cut, a thread is changed to another or a thread is cut at the end of sewing, whereby the needle thread 28 extending downward through an eye 15*a* of the needle 15 is hooked on the distal end of the thread wiper 62 to be wiped away. In the embodiment, however, the thread wiper 62 is designed to carry out a thread amount securing operation so that a predetermined amount of needle thread 28 located downstream relative to the needle eye 15*a* of the needle 15 may be secured. As shown in FIGS. 3 to 6, the wiper driving mechanism 32 includes the drive motor 46 commonly used to drive the needle bar releasing mechanism 31, a sector gear 47 formed with a detected part 60, a wiper origin detector 61 which detects an origin of a wiper 62, the wiper 62, a coupling plate 63 having both ends swingably coupled to the wiper 62 and the sector gear 47, a guide member 64 guiding the wiper 62 and a cover member 65 of the guide member 64.

The thread wiper 62 has a coupling wall 62*a* swingably coupled to the coupling plate 63 and a hook 62*b* provided for drawing up the needle thread 28. The thread wiper 62 is held between the guide member 64 and the cover member 65 so as to be slidable along a guide groove 64*a* formed in the guide member 64. The guide groove 64 guiding the thread wiper 62 is constructed to be capable of moving the thread wiper 62 rearward from a standby position when the drive motor 46 is driven to cause the sector gear 47 to pivot in the direction of arrow D as shown in FIGS. 4 and 6. The wiper origin detector 61 comprises a photointerrupter provided with a light receiving device and a light emitting device. The wiper origin detector 61 detects, as an origin, a position of the thread wiper 62 in the case where a lower edge of the detected part 60 passes between the light receiving device and the light emitting device.

Figure 2:
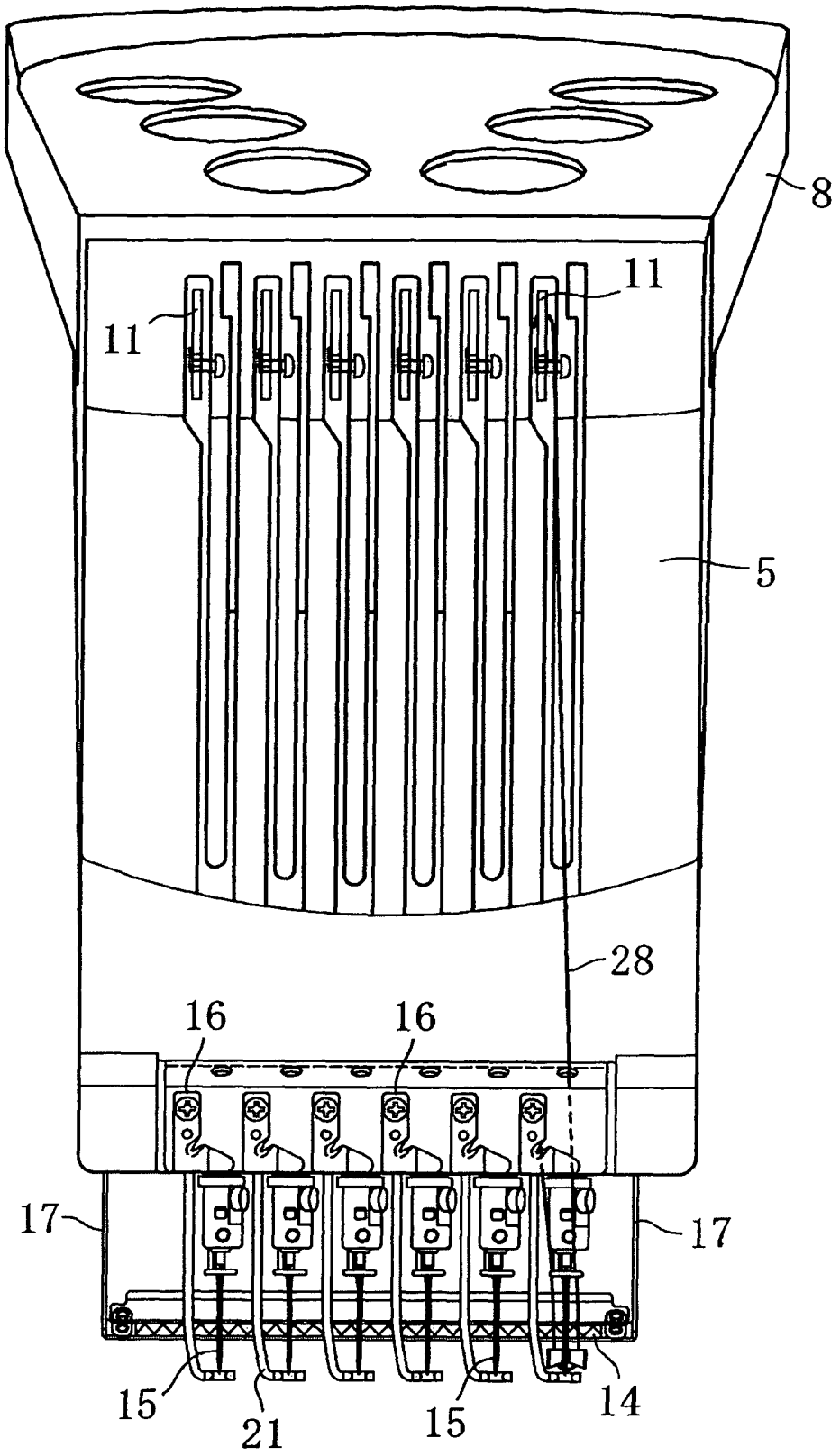
FIG. 2 is a front view of a needle bar case.

In the thread wiping, the drive motor 46 is driven so as to be rotated in a predetermined direction so that the sector gear 47 is rotated in the direction of arrow E in FIG. 4. Since the coupling plate 63 is moved forward with the rotation of the sector gear 47, the thread wiper 62 coupled to the lower end of the coupling plate 63 passes through the first thread retaining member 14 while being guided along the guide groove 64*a*, thereby moving forward by a predetermined stroke. At this time, since the hook 62*b* of the thread wiper 62 is moved to a thread wiping position below the needle 15, the hook 62*b* engages the needle thread 28 located downstream relative to the needle eye 15*a* (see two-dot chain line as shown in FIG. 2). In this state, when the drive motor 46 is driven so as to be reverse rotated, the thread wiper 62 is returned to the stand-by position via the sector gear 47 and the coupling plate 63. At this time, the needle thread 28 in engagement with the hook 62*b* of the thread wiper 62 is wiped away over the workpiece cloth to be retained by the thread retaining tape 14*a* of the first thread retaining member 14.

Figure 7:
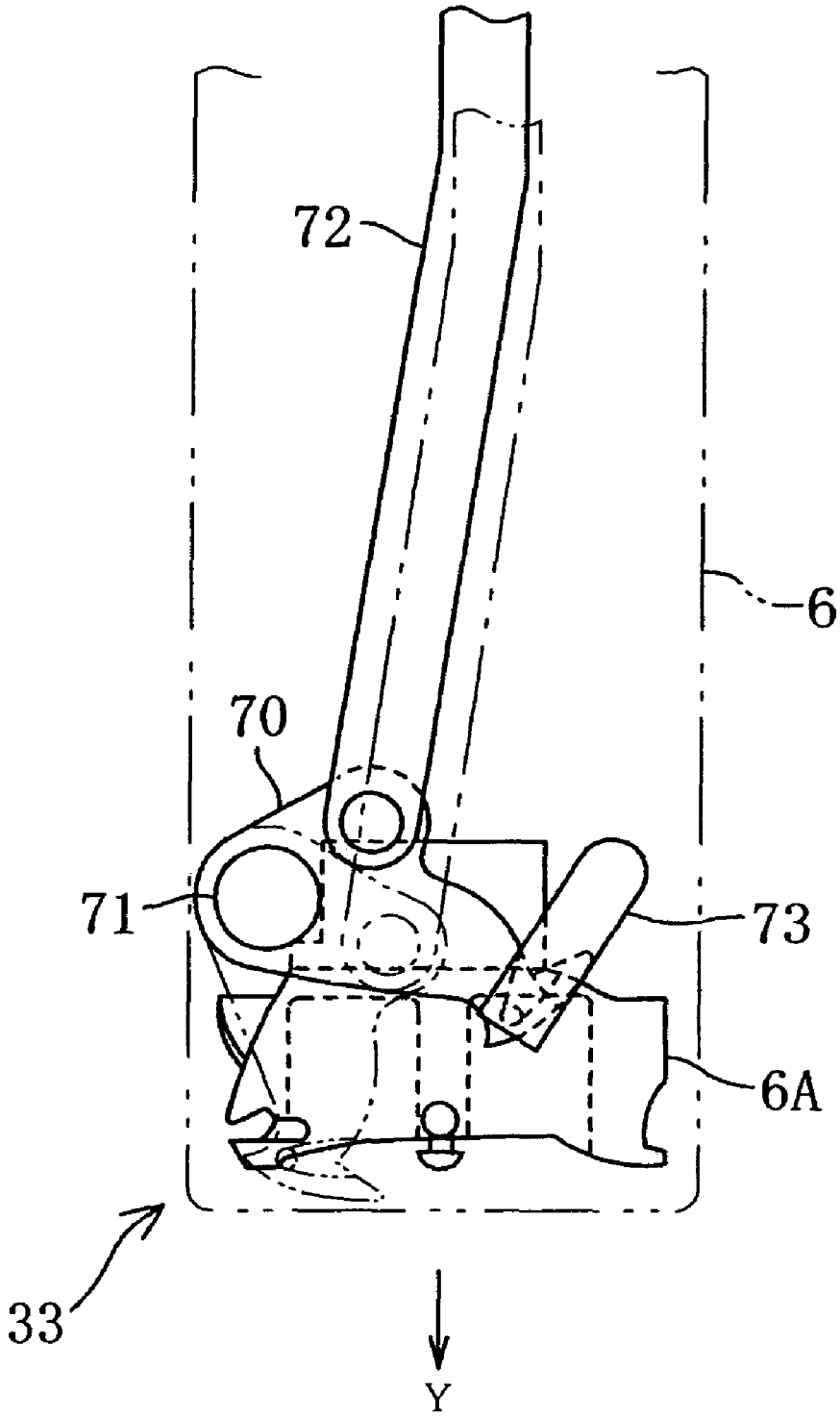
FIG. 7 is a plan view of a thread cutting mechanism.

Next, the thread cutting mechanism 33 provided on the cylinder bed 6 will be described. As shown in FIG. 7, a fixing plate (not shown) secured to the cylinder bed 6 is provided at the upper side of the rotary hook 6A, and a movable cutting blade 70 is pivotally mounted on a support pin 71 secured to the fixing plate. Furthermore, an operating lever 72 extending in the cross direction has a front end coupled to the movable cutting blade 70 and a rear end coupled to a movable cutting blade driving mechanism (not shown) having a thread cutting motor 84 (see FIG. 8). The movable cutting blade 70 is reciprocally swingable between a standby position shown by solid line and a maximum pivot position shown by two-dot chain line. Furthermore, a fixed cutting blade 73 cutting the needle thread 28 and bobbin thread in cooperation with the movable cutting blade 70 is fixed to the fixing plate with the blade portion thereof directed forward. Upon output of a needle thread cutting command, the positive rotation of the thread cutting motor 84 moves the operating lever 72 forward (a first half of reciprocal movement). With the forward movement of the operating lever 72, the movable cutting blade 70 is caused to pivot to the maximum pivot position. As the result of pivoting of the movable cutting blade 70, both needle thread 28 and bobbin thread are seized by the movable cutting blade 70. In this case, the needle thread 28 is divided into a part of the needle thread 28 at the sewing needle side and another part of the needle thread 28 at the workpiece cloth side.

Subsequently, the thread cutting motor 84 is reverse rotated so that the operating lever 72 is moved rearward. In this case, the part of the needle thread 28 located at the workpiece cloth side and seized by the movable cutting blade 70 and the bobbin thread are cut by the blade part of the fixing blade 73 simultaneously.

Figure 8:
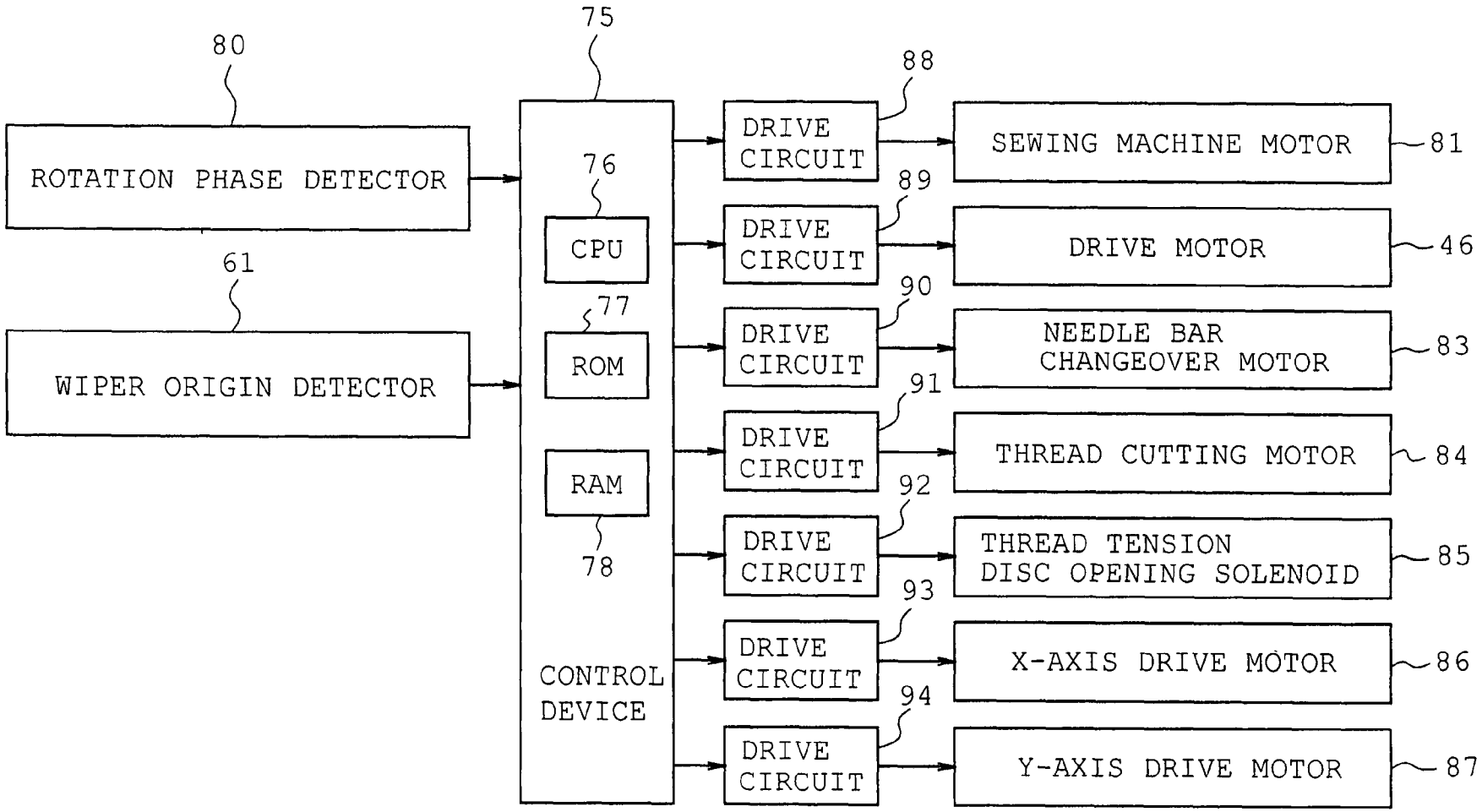
FIG. 8 is a block diagram showing a control system of the multi-needle embroidery machine.

Next, the control system of the multi-needle embroidery machine M will be described with reference to the block diagram of FIG. 8. A control device 75 controlling the multi-needle embroidery machine M comprises a microcomputer including a central processing unit (CPU) 76, a read only memory (ROM) 77 and a random access memory (RAM). Various signals are supplied to the control device 75. The signals include a rotation phase signal of the sewing machine main shaft detected by the rotation phase detector 80 and a signal delivered from the wiper origin detector 61 detecting the origin of the thread wiper 62. Furthermore, the control device 75 delivers drive signals to a drive circuit 88 of a sewing machine motor 81, a drive circuit 89 of the drive motor 46 operating the needle bar releasing mechanism 31 and the wiper drive mechanism 32, a drive circuit 90 of the needle bar change motor 83, a drive circuit 91 of the thread cutting motor 84, a drive circuit 92 of the thread tension disc opening solenoid 85 and drive circuits 94 and 95 of the X-axis and Y-axis drive motors 86 and 87.

The ROM 77 stores a drive control program for controlling the motors 81, 83, 84, 86 and 87 for the purpose of executing embroidery sewing, a plurality of types of sewing data and a control program for thread cutting which is peculiar to the invention and will be described later. In the thread cutting control, the thread wiper 62 is operated by the wiper driving mechanism 32 in the thread cutting so that a predetermined amount of thread is secured, whereby a predetermined amount of needle thread 28 is secured by the thread wiper 62. The RAM 78 is provided with a sewing data memory on which sewing data is used for sewing and various necessary memories.

Figure 9A:
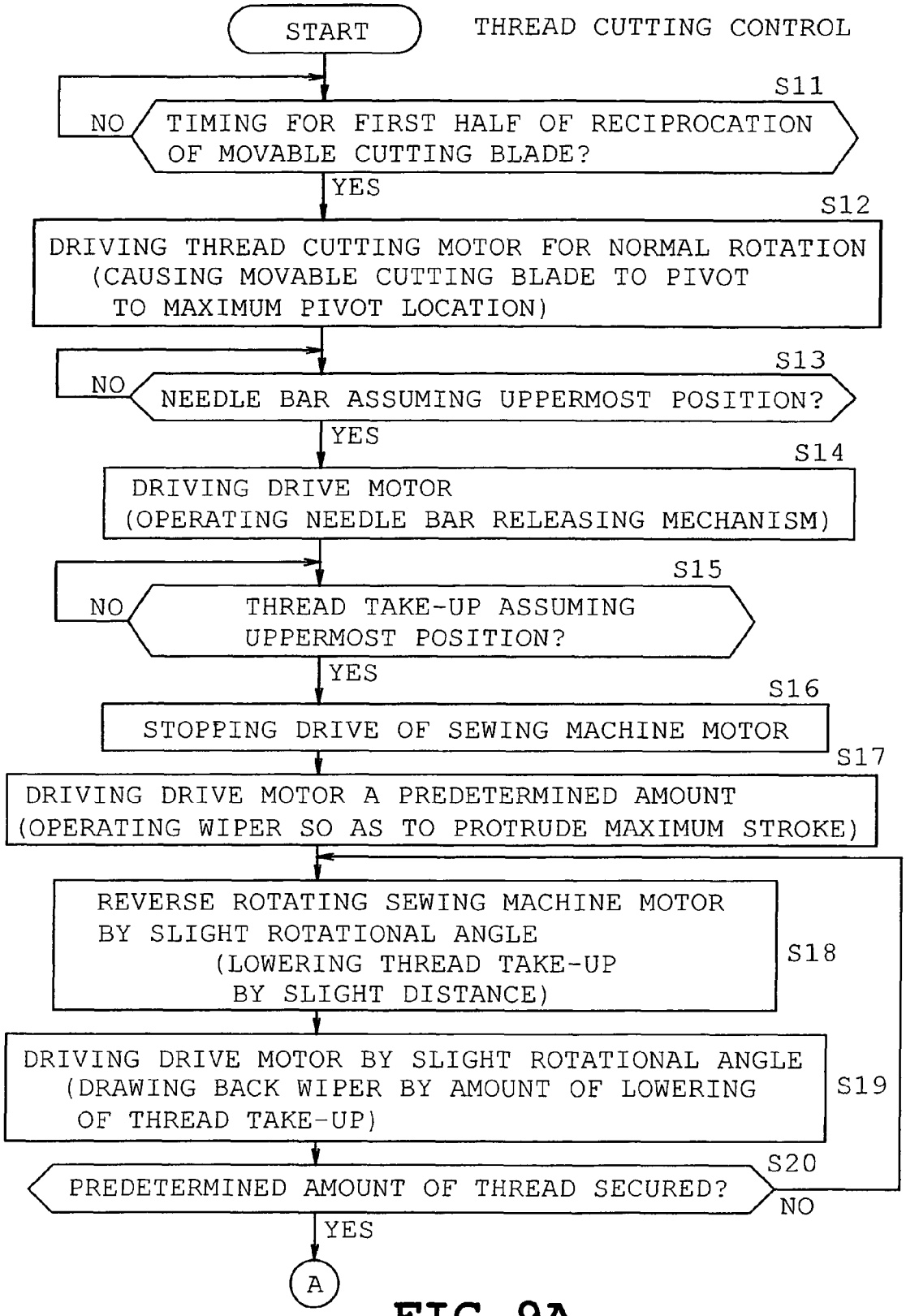
FIGS. 9A and 9B are flowcharts showing the thread cutting control.
Figure 9B:
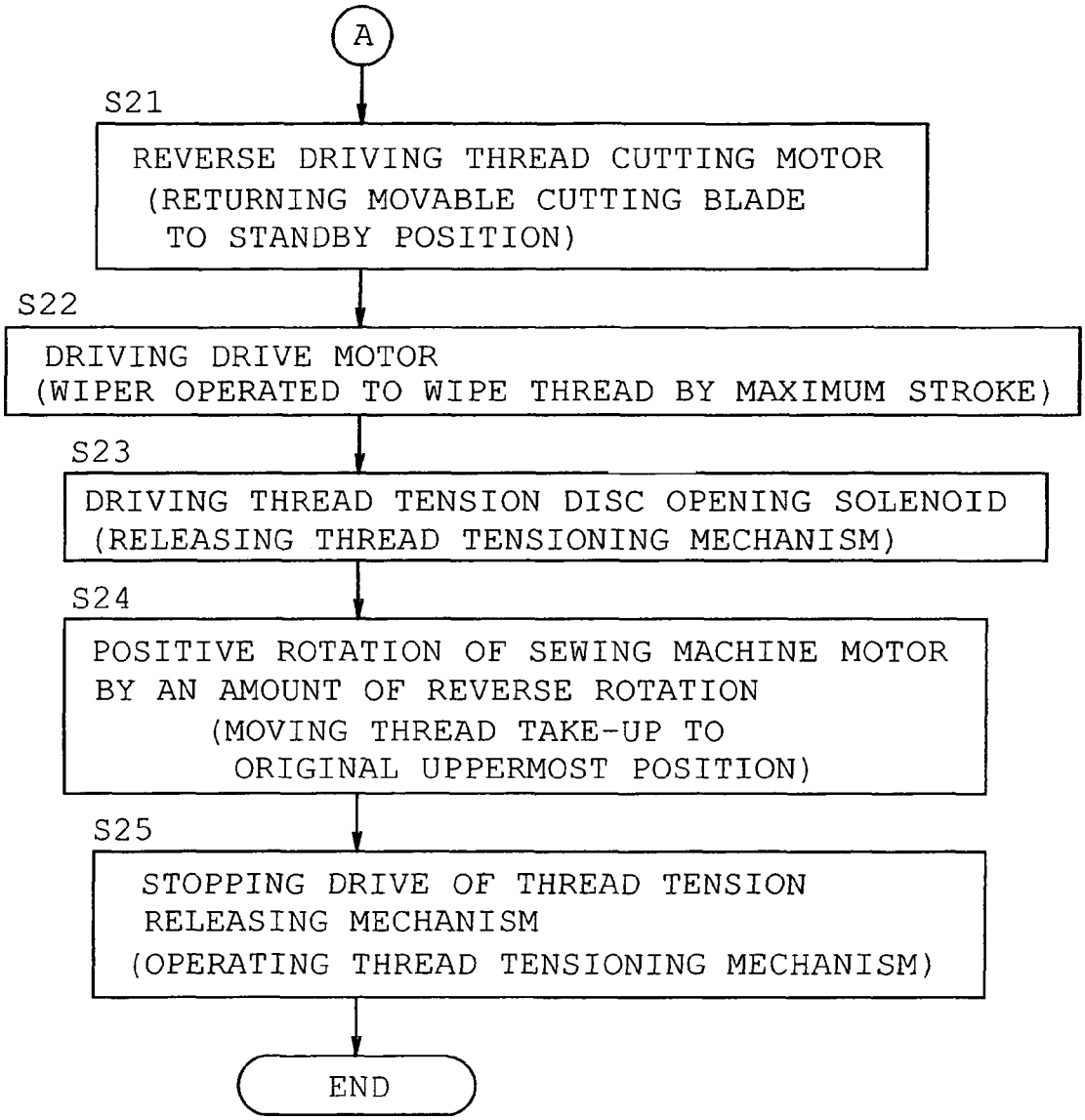

A thread cutting control executed by the control device 75 will be described with reference to FIGS. 9A and 9B which are flowcharts. Symbol Si (where i=11, 12, 13 . . . ) in FIGS. 9A and 9B designates each step. The thread cutting control starts when the embroidery sewing has been finished and a needle thread cutting command has been delivered. Upon stat of the thread cutting control, firstly, the thread cutting motor 84 is normally rotated when a rotation phase signal delivered from the rotation phase detector 80 indicates a timing of first half of reciprocal movement which moves the movable cutting blade 70 of the thread cutting mechanism 33 by a first half of reciprocal movement (S11: Yes), whereupon the movable cutting blade 70 is caused to pivot to the maximum pivot position (S12). As a result, the needle thread 28 and the bobbin thread are seized by the movable cutting blade 70 by the first half of the reciprocal movement of the movable cutting blade 70. In this case, the needle thread 28 is divided into the needle thread 28 part at the sewing needle side and the needle thread 28 part at the workpiece cloth side.

Subsequently, the drive motor 46 is driven so that the needle bar releasing mechanism 31 is operated (S14) when the needle bar 10 has been moved to the uppermost position (S13: Yes). As a result, the needle bar 10 is stopped at the uppermost position, whereby the needle bar 10 is retained at the uppermost position, whereupon the needle bar 10 is not vertically moved in synchronization with the sewing machine main shaft. Subsequently, when the thread take-up 11 is moved to the uppermost position (S15: Yes), the sewing machine motor 81 is stopped (S16).

Subsequently, the drive motor 46 is driven so that the thread wiper 62 is moved (projected) forward by maximum stroke (S17). As a result, the needle thread 28*a* located downstream relative to the needle eye 15*a* of the needle 15 assumes a location where the needle thread 28*a* is engageable with the hook 62*b* of the wiper 62. Next, the sewing machine motor 81 is reverse rotated by a predetermined slight rotational angle, so that the thread take-up 11 is moved downward by a slight distance (S18). The drive motor 46 is driven by a slight rotational angle in synchronization with the downward movement of the thread take-up 11, so that the thread wiper 62 is returned so that the needle thread 28 loosened as the result of downward movement of the thread take-up 11 is drawn in. More specifically, the thread wiper 62 is moved rearward with the thread take-up 11 being moved downward while the hook 62*b* of the thread wiper 62 is in engagement with the needle thread 28*a* at the sewing needle side. Accordingly, the needle thread 28*a* at the sewing needle side is rendered gradually longer such that an extra amount of needle thread 28 is secured. In this case, when the amount of needle thread 28*a* secured by the rearward movement of the thread wiper 62 (drawing) is below a predetermined amount (S20: No), S18 and S19 are repeated so that the thread amount securing operation is carried out by the wiper 62.

Figure 10:
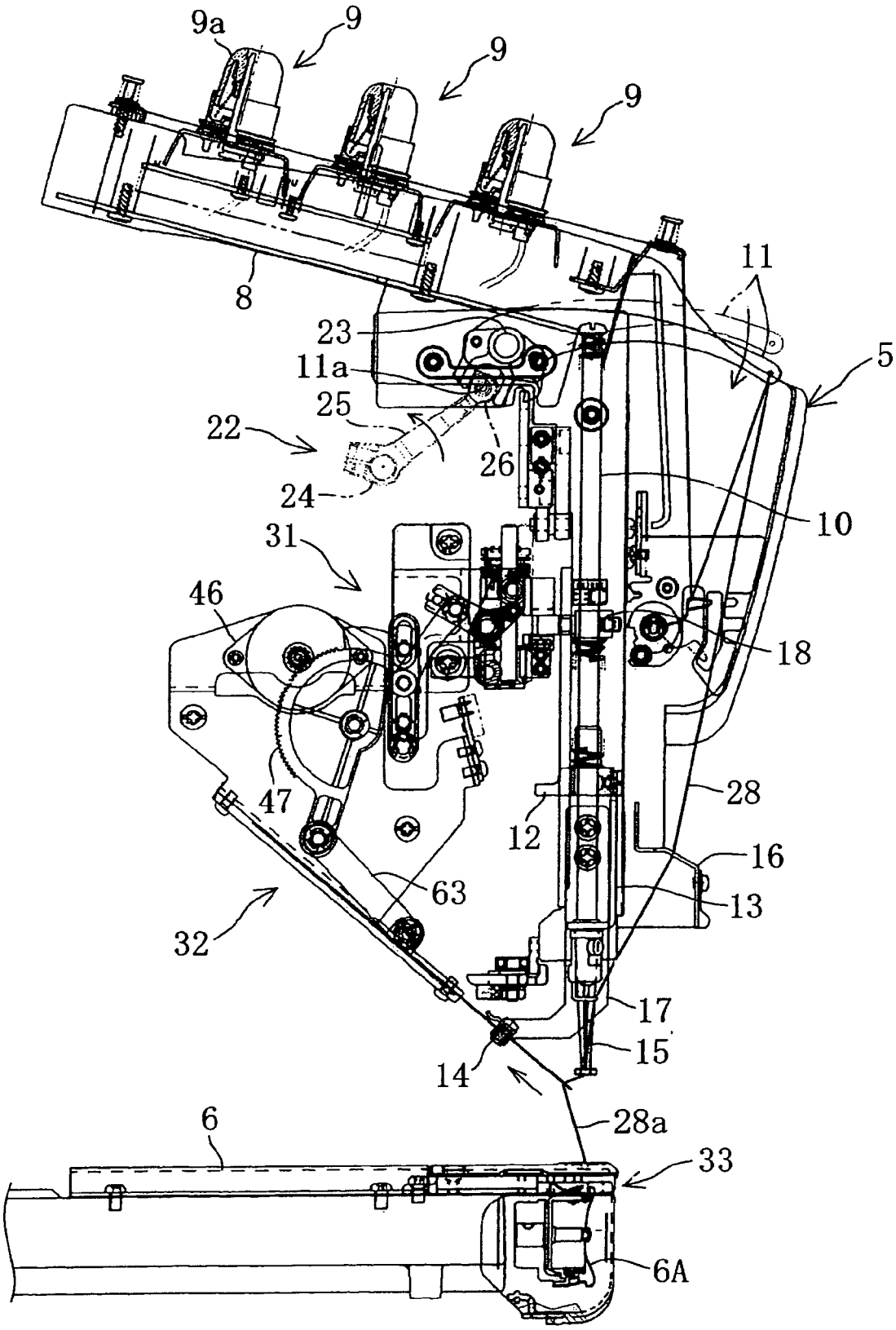
FIG. 10 is a view similar to FIG. 3, showing the case where a thread amount securing operation has been carried out by a wiper.

More specifically, as shown in FIG. 10, the needle thread 28*a* located downstream relative to the needle eye 15*a* of the needle 15 at the workpiece cloth side is bent into a generally inclined L-shape such that a secured amount of the needle thread 28 is gradually increased. When the secured amount of needle thread reaches a predetermined amount (20 to 25 mm, for example; and S20: Yes), the thread cutting motor 84 is reverse rotated so that the movable cutting blade 70 is returned to the standby position, whereupon the needle thread 28 at the workpiece cloth side and the bobbin thread are simultaneously cut by the fixed cutting blade 73 (S21). Since an amount of needle thread secured by the thread amount securing operation of the thread wiper 62 is readily supplied through the needle eye 15*a* from the thread take-up 11 side by the lowering of the thread take-up 11, a predetermined extra amount of thread of the needle thread 28 is reliably secured.

Subsequently, the drive motor 46 is re-driven so that the thread wiper 62 wipes the needle thread 28 with movement thereof by maximum stroke rearward movement after the thread amount securing operation (S22). In this case, the needle thread 28 is retained by the thread retaining tape 14*a* of the first thread retaining member 14 as described above. Subsequently, the thread tension disc opening solenoid 85 is driven so that the thread tension adjusting mechanism 9 is opened (S23). In this state, the sewing machine motor 81 is positively rotated by a rotational angle of reverse rotation at S18 so that the thread take-up 11 is moved upward to the original position (S24).

Since the thread tension adjusting mechanism 9 is already open in the upward movement of the thread take-up 11, an amount of needle thread necessary for upward movement of the thread take-up 11 is fed from the side of the thread tension adjusting mechanism 9 to which no thread tension is applied, that is, from a thread spool. Accordingly, an amount of thread at the needle thread end extending through the needle eye 15*a* of the needle 15 is prevented from being reduced. Thereafter, the drive of the thread tension opening solenoid 85 is stopped and the thread tension adjusting mechanism 9 is operated (S25). The thread cutting control is thus finished.

When the needle thread 28 is seized by a beak of an outer rotary hook of a rotary hook 6A in starting a subsequent sewing operation, the movable cutting blade 70 pivots to a location of maximum pivot so that the needle thread 28 is seized by the movable cutting blade 70. As a result, the needle thread end 28*a* remaining on the upper side of the workpiece cloth is drawn into the lower side of the workpiece cloth. In other words, the needle thread end 28*a* no longer remains at the upper side of the workpiece cloth.

Thus, the multi needle embroidery sewing machine M is provided with the needle bar 10, thread take-up 11, thread take-up driving mechanism 22, thread cutting mechanism 33, thread wiper 62 and wiper driving mechanism 32. When receiving a needle thread cutting command for actuating the thread cutting mechanism 33, the control device 75 controls the movable cutting blade driving mechanism and the thread wiper driving mechanism so that the thread wiper 62 executes a thread amount securing operation to ensure the predetermined amount of needle thread located downstream relative to the eye 15*a* of the needle 15 in the case where the needle thread 28 which has been seized by the movable cutting blade 70 is in a state previous to the cutting of the needle thread 28. Accordingly, the needle thread 28 is cut by the movable cutting blade 70 after the thread wiper 62 in engagement with the needle thread 28 has been operated for securing a thread amount when the needle thread 28 which has been seized by the movable cutting blade 70 is in a state previous to the cutting of the needle thread 28. As a result, an extra remaining amount of needle thread 28 cut can be obtained according to an amount of thread amount securing operation of the thread wiper 62.

Thus, an extra amount of needle thread remaining after the cutting of the needle thread can be secured by the operation of the thread wiper 62 for securing a thread amount without provision of a picker and a drive motor driving the picker in the cylinder bed 6. Consequently, a reduction in the number of components can reduce the manufacturing costs, and the size of the cylinder bed 6 can be reduced. Furthermore, a necessary amount of needle thread remaining after thread cutting can be secured reliably and accurately. Additionally, since no picker is necessary, the distance between the rotary hook 6A and the front end of the cylinder bed 6 can be reduced. Consequently, a sewing range can be increased.

Furthermore, the control device 75 controls the thread take-up driving mechanism 22 so that when the thread wiper 62 is to be caused to execute the thread amount securing operation, the thread take-up 11 is lowered a predetermined distance so that a predetermined amount of thread is secured by the thread wiper 62. Thus, the predetermined amount of thread can easily be secured by the lowering of the thread take-up 11.

Furthermore, the embroidery machine M further comprises the thread tension adjusting mechanism 9 which adjusts a tension of the needle thread 28 and the thread tension driving mechanism which drives the thread tension adjusting mechanism 9. When the thread wiper 62 is caused to execute the thread amount securing operation, the control device 75 controls the thread tension driving mechanism so that the thread tension adjusting mechanism 9 is opened so that a predetermined amount of needle thread 28 can easily be secured by the opening of the thread tension adjusting mechanism 9.

Furthermore, the embroidery machine M further has the needle bar releasing mechanism 31 turns on and off the driving force of the needle bar driving mechanism 30 driving the needle bar 10. When the thread wiper 62 is to be operated to ensure a predetermined amount of thread, the control device 75 controls the needle bar releasing mechanism 31 so that the drive of the needle bar 10 is interrupted by the needle bar releasing mechanism 31. Accordingly, since the needle bar 10 is stopped at the uppermost position, an extra amount of needle thread 28 secured by the thread wiper 62 can be rendered stable. Moreover, the interference can reliably be avoided between the sewing needle 15 mounted on the lower end of the needle bar 10 and the thread wiper 62.

Modified forms of the foregoing embodiment will be described in the following. The thread tension adjusting mechanism 9 may be opened at S18 where the thread cutting control is executed as described above. In this case, the needle thread 28 drawn out by the thread amount securing operation of the thread wiper 62 is easily supplied from the thread spool through the thread take-up 11 and the needle eye 15*a* to the thread wiper 62. Consequently, an amount of thread remaining after the thread cutting can reliably be secured. Furthermore, an amount of operation for drawing out the needle thread 28 by the thread wiper 62 may optionally be settable according to a type, size and material of the needle thread 28. Thus, the invention should not be limited to the foregoing embodiment. Those who are skilled in the art can modify the foregoing embodiment into various forms without departing from the gist of the invention. The invention encompasses these modifications.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A sewing machine comprising:

a thread take-up;

a thread take-up driving mechanism which drives the thread take-up;

a sewing machine motor which drives the thread take-up driving mechanism;

a thread cutting mechanism including a fixed cutting blade, a movable cutting blade both of which cut a needle thread, and a movable cutting blade driving mechanism which drives the movable cutting blade;

a thread wiper which wipes the cut needle thread away over workpiece cloth to be sewn;

a wiper driving mechanism which drives the thread wiper;

a thread tension adjuster which adjusts a tension of the needle thread;

a thread tension adjuster driving mechanism which drives the thread tension adjuster; and a control device coupled to:

the sewing machine motor, the thread cutting mechanism, the wiper driving mechanism, and the thread tension adjuster driving mechanism, wherein the control device is configured to execute a needle thread cutting operation including:

driving the movable cutting blade to a predetermined pivot location;

driving the wiper driving mechanism for protruding the wiper by a predetermined stroke;

driving the thread take-up driving mechanism to lower the thread take-up by a predetermined distance;

driving the wiper driving mechanism to draw back the wiper by a predetermined amount corresponding to the lowering of the thread take-up;

driving the movable cutting blade to a standby position;

driving the thread tension adjusting mechanism to release the thread tension adjusting mechanism; and driving the thread take-up driving mechanism to move the thread take-up to an original uppermost position.

2. The sewing machine according to claim 1, further comprising a needle bar having a lower end to which a sewing needle is attached and a needle bar releasing mechanism which intermits a driving force of a needle bar driving mechanism which drives the needle bar, wherein when the thread wiper is operated to secure the predetermined amount of thread, the control device controls the needle bar releasing mechanism so that drive of the needle bar is interrupted by the needle bar releasing mechanism.

* * * * *